US005378356A

United States Patent [19]

Logsdon

[11] Patent Number: 5,378,356

[45] Date of Patent: Jan. 3, 1995

[54] ROOF DRAIN STRUCTURE

[75] Inventor: Duane D. Logsdon, Fullerton, Calif.

[73] Assignee: LSP Specialty Products Company, Irving, Tex.

[21] Appl. No.: 131,080

[22] Filed: Oct. 1, 1993

[51] Int. Cl.[6] ..... E04D 13/04

[52] U.S. Cl. ..... 210/163; 210/166

[58] Field of Search ..... 210/163, 164, 165, 166, 210/170; 52/302.1, 302.6, 169.5

[56] References Cited

U.S. PATENT DOCUMENTS

| | | | |
|---|---|---|---|
| 1,963,300 | 6/1934 | Fleming | 210/163 |
| 1,999,277 | 4/1935 | Boosey | 210/163 |
| 2,003,670 | 6/1935 | Goodhart | 210/163 |
| 2,079,269 | 5/1937 | Williams | 210/163 |
| 2,283,160 | 5/1942 | Boosey | 210/163 |
| 3,095,219 | 6/1963 | Tutty | 210/163 |
| 3,378,858 | 4/1968 | Jacuzzi | 4/172 |
| 3,469,698 | 9/1969 | Blendermann | 210/163 |
| 3,517,813 | 6/1970 | Thaler | 210/166 |
| 3,529,723 | 9/1970 | Hagedorn | 210/163 |
| 3,670,894 | 6/1972 | Friedl | 210/164 |
| 3,706,379 | 12/1972 | Erlich | 210/169 |
| 3,884,809 | 5/1975 | Logsdon | 210/163 |
| 4,035,297 | 7/1977 | Aldridge et al. | 210/163 |
| 4,487,690 | 12/1984 | Logsdon | 210/163 |
| 4,943,100 | 7/1990 | Emberson | 210/164 |
| 4,964,180 | 10/1990 | Harbeke | 210/163 |

OTHER PUBLICATIONS

Tech Specialties: Plastic Drains and Accessories.

*Primary Examiner*—Christopher Upton
*Attorney, Agent, or Firm*—Price, Gess & Ubell

[57] ABSTRACT

The present invention relates to a roof drain structure comprised of a drain plate having an upstanding overflow port and a clamp ring used to secure an edge of the roofing substrate against the drain plate and around the overflow port. The clamp ring surrounds and physically cooperates with the overflow port to align several screw apertures and the clamp ring with several corresponding apertures in the drain plate. There are preferably at least two alternative drain plates having different size overflow ports, and a clamp ring that may be modified to fit either of the ports and still align the screw apertures. The preferred clamp ring has removable spokes that are left in place for use with a smaller overflow port and that are removed for use with a larger overflow port. The overflow port is preferably stepped to have a lower larger portion and an upper smaller portion so that the contractor can modify the overflow port in the field to accommodate different sized drain pipes. The preferred drain structure also includes a drain grate and alternative adapters that may be used to connect the drain grate to any one of several different sized pipes. The preferred adapter includes exterior notches that allow passage of the removable spokes of the clamp ring. In this fashion, it is possible to unscrew and remove the clamp ring without having to remove the ordinarily permanently cemented adapter.

25 Claims, 5 Drawing Sheets

10
80
82
73
16
17
73a
70
71
31
36
35
45
46
40
90
42
50
52

ROOF DRAIN STRUCTURE

BACKGROUND OF THE INVENTION

1. Field of the Invention

The present invention relates to "scupper drains" which are drain structures used to remove water from flat or nearly flat roofs of the kind that are constructed by applying any variety of roofing substrates over a base comprised typically of wood or concrete.

2. Description of Related Art

There are numerous varieties of flat roofs that require scupper drains. Scupper drains are often used, for example, with flat layered roofs comprised of a support base made from wood framing and plywood sheets and a substrate made from one or more layers of "roofing felt" and tar.

One or more scupper drains are located at strategic places on the roof so that water, flowing into the drain, can be removed from the, roof through appropriate plumbing. Most community building codes requires a primary drain and a secondary drain. The primary drain is generally flush with the roofing substrate so that, subject to inherent drainage rate limitations, water drains immediately from the roof through the primary drain. The overflow drain generally serves as a backup in case the primary drain becomes clogged or is otherwise unable to remove the water as quickly as it accumulates on the roof. Although it is not necessary, commercial scupper drains often include a primary drain and an overflow drain in one structure.

The community building codes ordinarily specify a required "flood level", often two inches (2″), at which point water should also begin to flow into the overflow drain. Accordingly, the top of the overflow drain must be installed at a specified height above the roofing substrate. The required flood level must be achieved during construction of a new roof and also during the repair or reconstruction of an existing roof. Maintaining the required flood level is often troublesome when repairing an existing roof because the contractor sometimes installs and sometimes removes layers of roofing substrate.

An exemplary scupper drain is described and disclosed in U.S. Pat. No. 3,884,809 which issued to the present inventor on May 20, 1975. The contents of the U.S. Pat. No. 3,884,809 are hereby incorporated and made a part of this disclosure as if fully set forth herein.

It is of course important to prevent water from leaking into or through the roof. This is especially true since such leakage can cause a catastrophic failure of the entire structure. A common leakage point is the interface between the roof drains and the layers of roofing substrate. This kind of leakage is an especially critical problem in communities that experience severe temperature changes. The leak occurs because the roofing layers expand and contract around the drain. Over time, the roofing layers may literally lift away from the support base around the drain, forming a gap. As a result, water that would ordinarily flow through the drain may instead flow into the gap between the support base and the roofing layers.

Another problem with known roof drains is lack of versatility. In particular, because the contractor may stock or be required to use different size drain pipes, the manufacture must make and the roofing contractor must buy, and often stock at great expense, different sized roof drains and different-sized components. The result is more components and additional cost to all concerned.

Some size versatility was provided by the "stepped" drain ports like those shown in U.S. Pat. No. 3,884,809. However, no known prior art roof drain provides size versatility with respect to different sized drain pipes and related drain components such as clamp rings and grates.

SUMMARY OF THE INVENTION

It is an object of tile present invention to provide a roof drain structure that solves the above-described problems associated with prior art scupper drains.

In particular, it is an object of the present invention to provide a roof drain structure having components that are versatile in size, use, and cooperation with one another, so that fewer components are needed to accommodate installations using different sized drain pipes;

It is a further object of the present invention to provide a roof drain structure that can be partially disassembled and then reassembled to allow reconstruction of an existing roof;

It is a further object of the present invention to provide a roof drain structure that is simple to install; and;

It is a further object of the present invention to provide a roof drain structure that is cost effective to manufacture.

A roof drain structure according to the present invention is comprised of (1) a drain plate having an upstanding overflow port and (2) a clamp ring for securing an edge of the roofing substrate against the drain plate and around tile overflow port, the clamp ring surrounding and physically cooperating with the overflow port to align a plurality of connecting apertures in the clamp ring with a corresponding plurality of connecting apertures in the drain plate.

The preferred roof drain structure is further comprised of at least two alternative drain plates having different size overflow ports, a larger one and a smaller one, and a clamp ring that may be modified to fit either of the different sized overflow ports and still align the connecting apertures of the clamp ring with those of the drain plate. The preferred clamp ring has removable members that are left in place for use with the drain plate having the smaller overflow port and are removed for use with the drain plate having the larger overflow port.

The preferred overflow port is "stepped" to have a lower larger portion and an upper smaller portion so that the contractor may modify the overflow port, in the field, to accommodate different sized drain pipes. The overflow port may be modified for use with the smaller pipe by removing part of its upper smaller portion and for use with the larger pipe by removing all of its upper portion and part of its lower larger portion.

The preferred drain structure includes a drain grate of a single bottom diameter that mates with a larger drain pipe and one or more annular grate adapters for adapting the larger bottom of the drain grate to a smaller drain pipe. The grate adapter is ordinarily cemented permanently to the drain pipe with an appropriate solvent.

The preferred grate adapter includes a plurality of notches that spatially correspond to the removable members of the clamp ring to allow reconstruction of an existing roof on which a roof drain according to the present invention was already installed. In particular, when the preferred grate adapter is used to adapt the grate to a smaller pipe, then the clamp ring bears its removable spokes for use with a smaller overflow port. The grate adapter would ordinarily interfere with the clamp ring's removable members. However, due to the notches of the grate adapter, the clamp ring may be removed without having to remove the grate adapter, the clamp ring's removable members passing through the grate adapter's notches without interference.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

Figures 7A, 7B, 7C, 9:
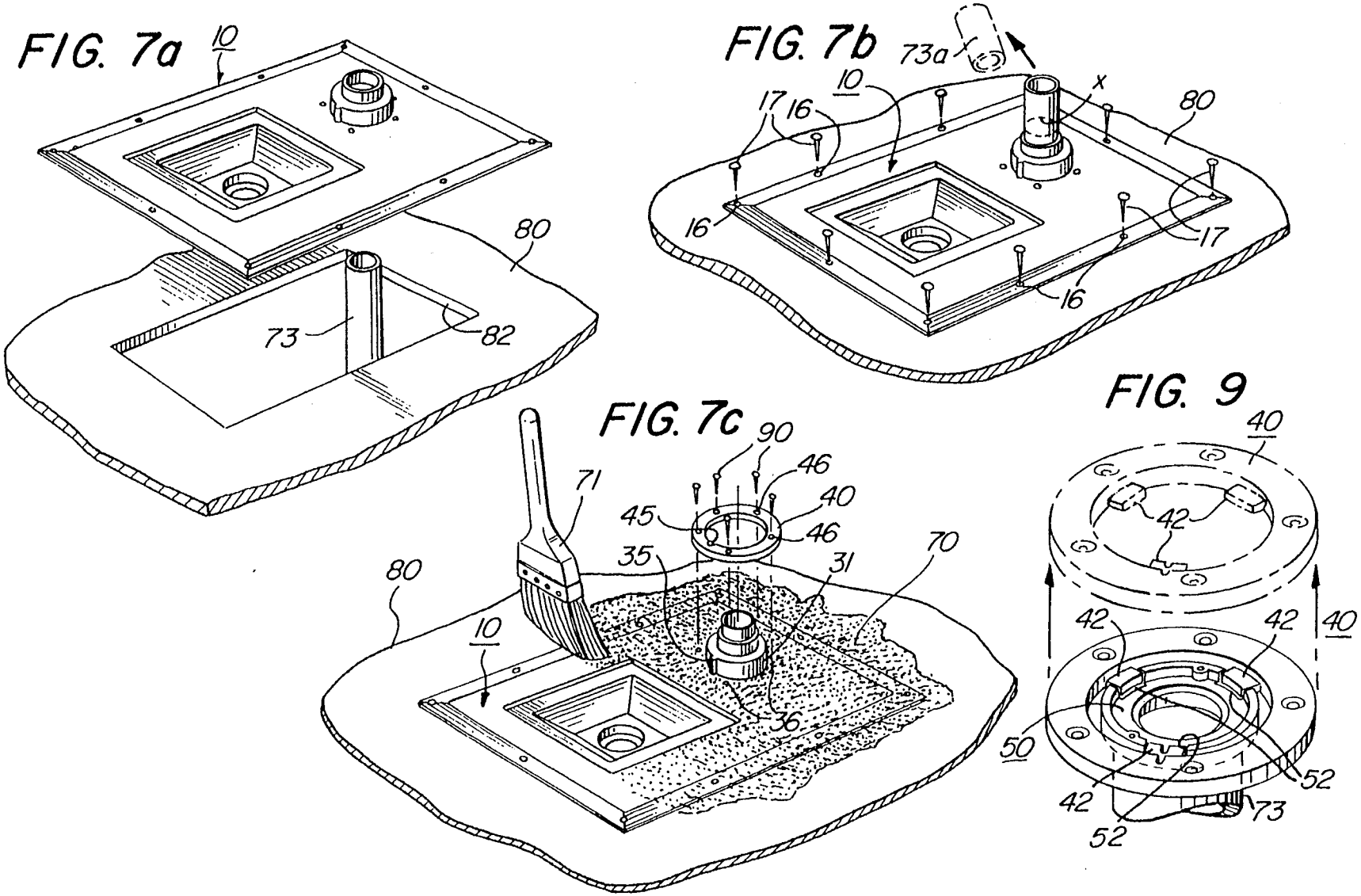
Figure 8:
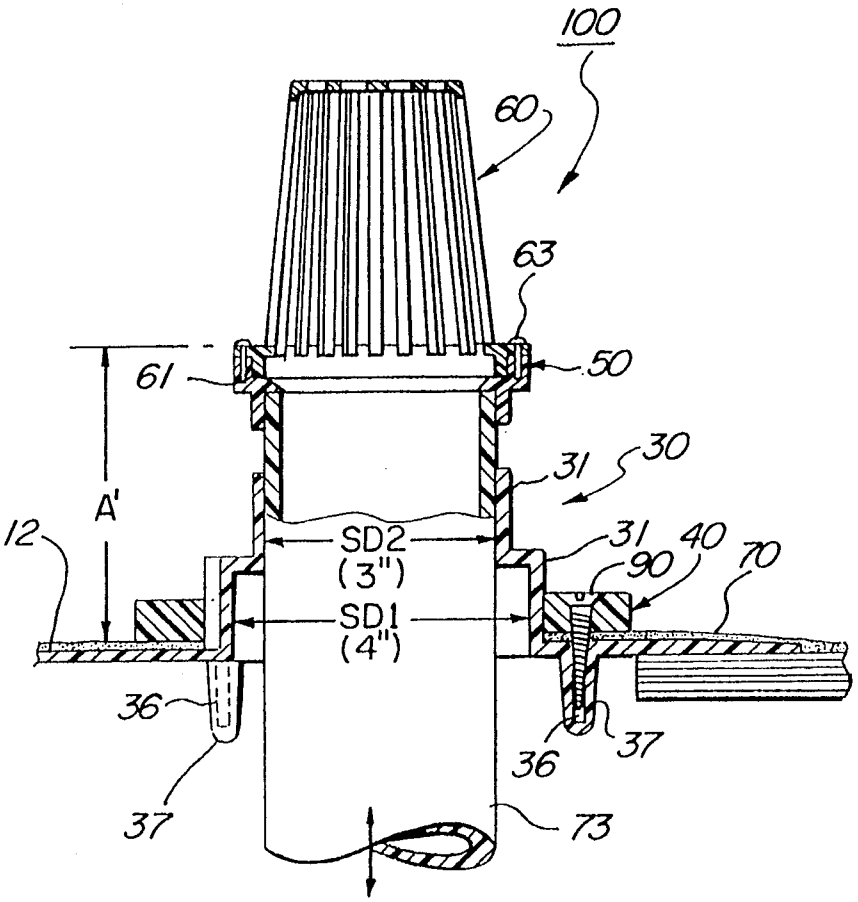
Figure 7D:
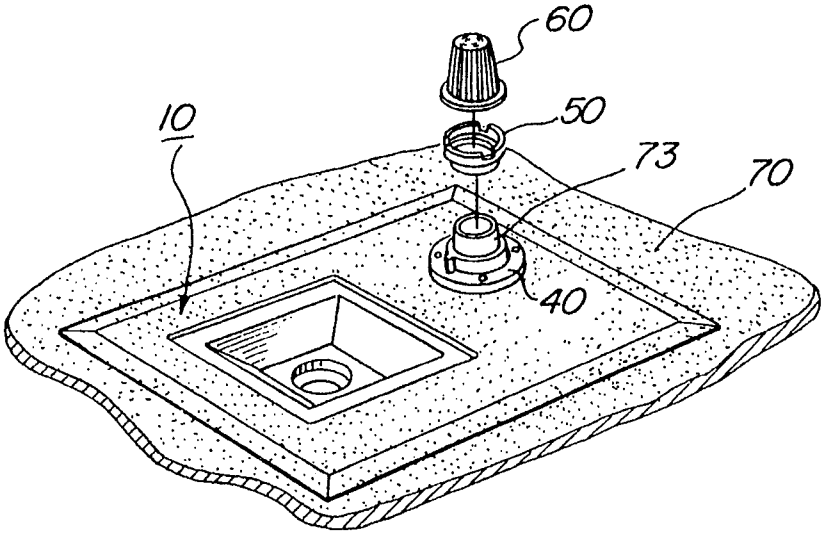
Figure 7E:
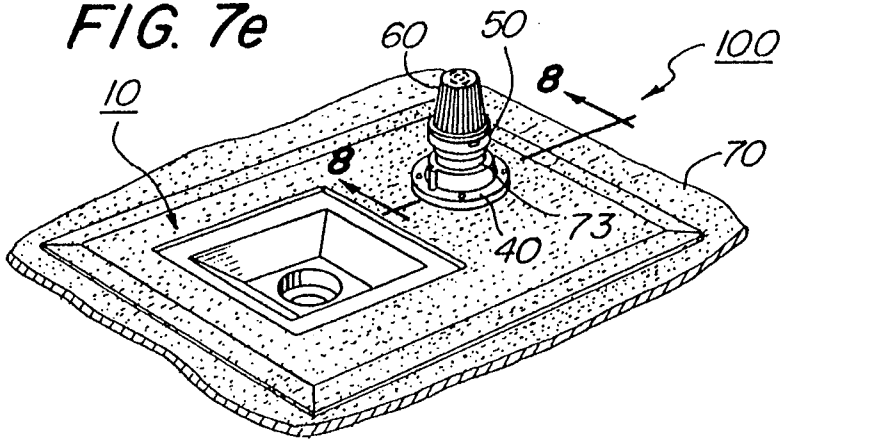
Figure 10:
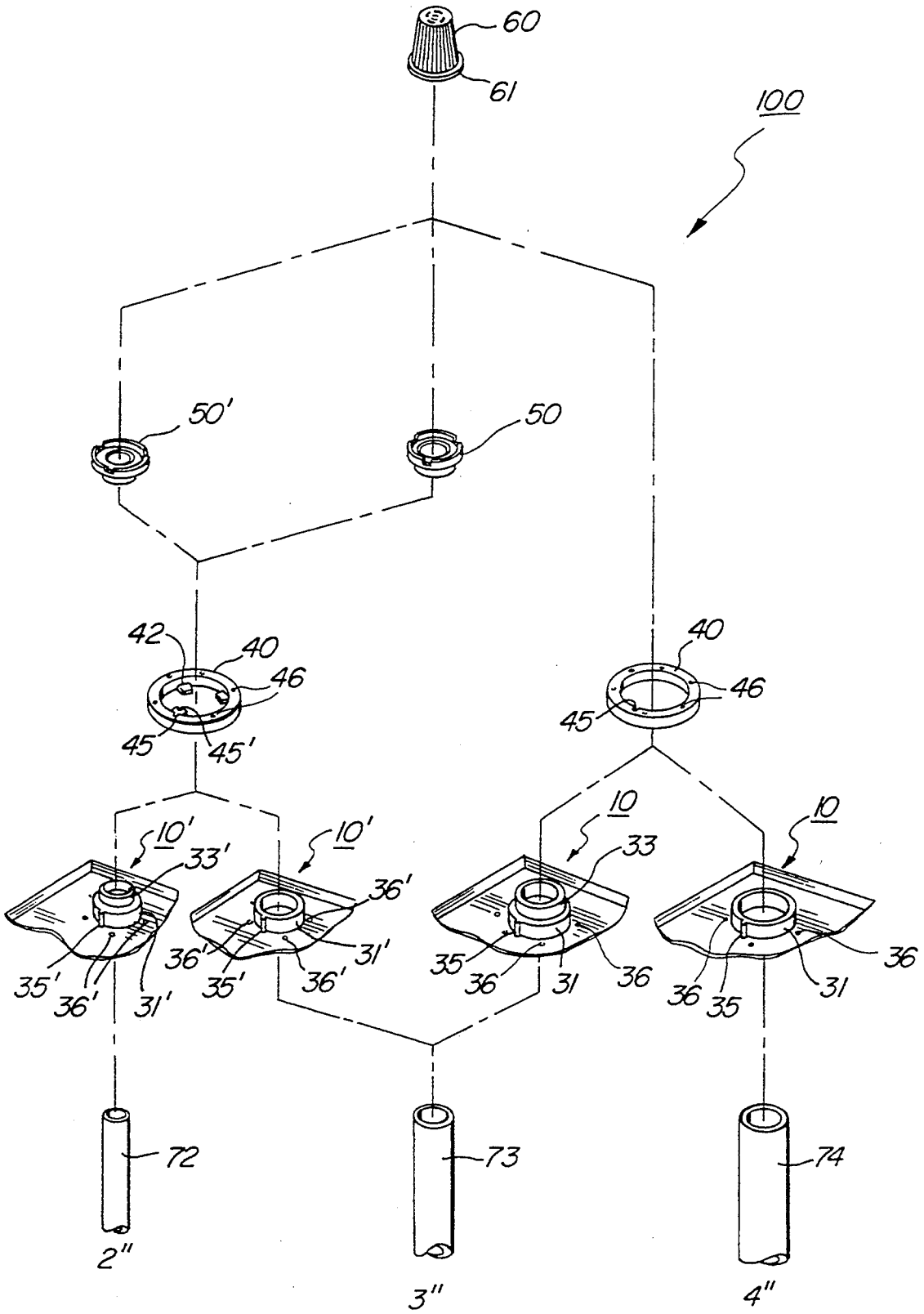

FIGS. *7a, 7b, 7c, 7d,* and *7e* illustrate the steps of an exemplary installation of the preferred roof drain structure;

FIG. 8 is a cross-sectional view of the roof drain structure of FIG. *7e* taken along section lines 8—8, illustrating the roofing substrate 70 clamped beneath the clamp ring 40 and the flood level A', as measured from the top of the roofing substrate 70 to the top of the grate adapter 50;

FIG. 9 is a perspective view of the grate adapter 50 and the clamp ring 40, illustrating how the removable spokes 42 of the clamp ring 40 may pass through a corresponding plurality of notches 52 in the grate adapter 50; and FIG. 10 is an exploded perspective view illustrating all of the possible interconnections between the various components of the preferred roof drain structure of the present invention when used with one of three possible size drain pipes.

DESCRIPTION OF THE PREFERRED EMBODIMENTS

FIG. 10 illustrates the components and beneficial versatility of a roof drain structure 100 according to the present invention. The preferred drain structure 100 is, as shown, designed for versatile use with one of three possible sized drain pipes 72, 73, 74 having outside diameters of two inches (pipe 72), three inches (pipe 72), or four inches (pipe 74). These are common pipe sizes in the roofing industry. The concepts embodied in the present invention could, of course, be used with other size pipes, more than three different size pipes, or both.

The preferred roof drain structure 100, with continued reference to FIG. 10, comprises first and second alternative drain plates 10, 10', a clamp ring 40, first and second alternative grate adapters 50, 50', and a grate 60. The construction and interconnection of the various components of the preferred roof drain structure 100 will be further described below with reference to other figures.

Figure 1:
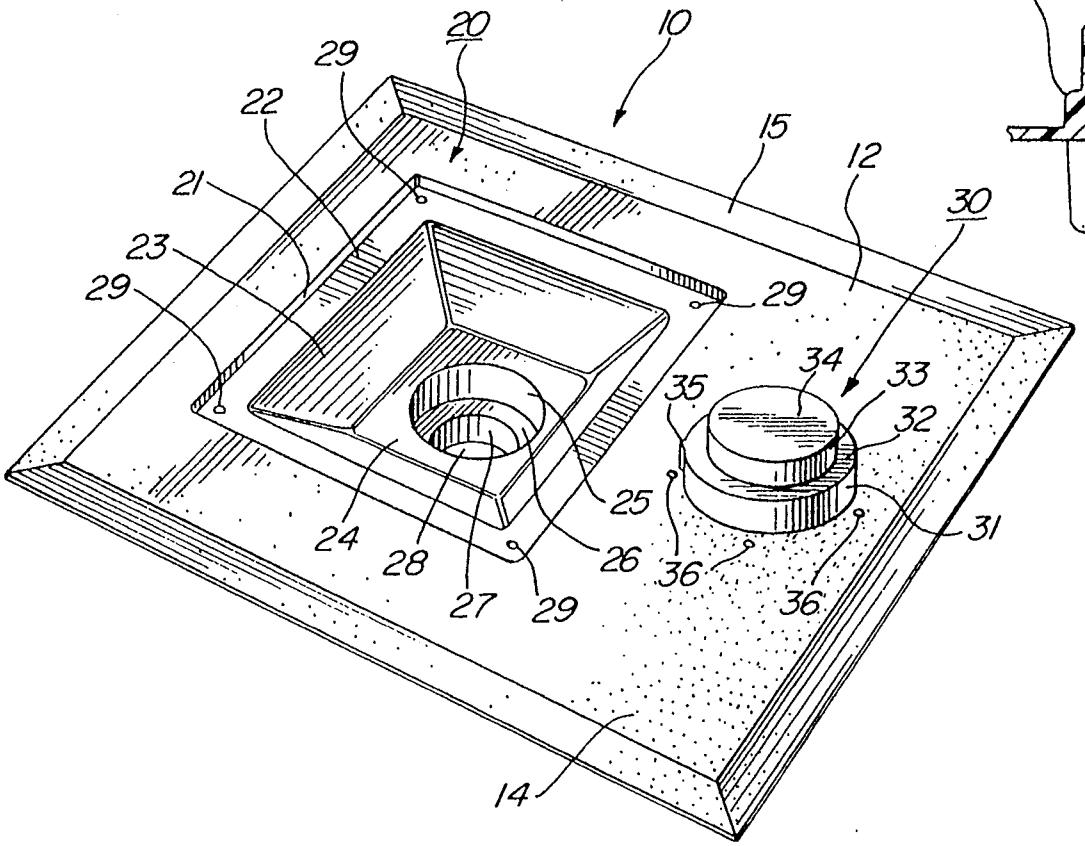
FIG. 1 is a perspective view of a drain plate 10 of a preferred roof drain structure according to the present invention.

The construction of the first and second alternative drain plates 10, 10' are best illustrated by FIG. 1. Only the first alternative drain plate 10 is actually shown in FIG. 1. However, the first and second alternative drain plates 10, 10' are structurally identical and differ only in terms of certain dimensions. Where appropriate, as in FIG. 10, similar parts of the first and second alternative drain plates 10, 10' are identified with similar numbers, for example 12 and 12'.

The drain plate 10 of FIG. 1 is generally comprised of a flat body 12 having a tapered perimeter edge 15. The preferred drain plate 10 includes a primary drain port 20 and a secondary or overflow port 30.

The drain plate 10 is preferably injection molded from a thermoplastic selected from the group including ABS plastic, PVC, polyethylene, polypropylene, and styrene. The preferred thermoplastics are ABS and PVC plastics because such materials are the two primarily used in "DWV" (drainage, waste and vent) applications. The roof drain structure 100 of the present invention could, of course, be made from other polymers and non-polymers, such as cast iron, copper, and galvanized sheet metal, with substantially equal results.

The primary port 20 drains water from a roof under normal conditions, transporting water that spills into it through a drain aperture 28 connected to a primary drain pipe (not shown). The primary port 20 is comprised generally of sloping walls 23 that incline downward to a lower flat surface 24. The lower flat surface 24 carries a first cylindrical wall 25 of a first diameter PD1. A shoulder 26, located at a bottom of the first cylindrical wall 25, carries a second cylindrical wall 27 of a second smaller diameter PD2. The primary port 20 preferably includes a perimeter wall 21 that defines a flat perimeter mounting surface 22 around the sloping wall 23 for receiving a grate (not shown) . Several screw apertures 29 are provided so that the grate may be securely attached to the flat perimeter mounting surface 22. The screw apertures 29 are formed in bosses ( not shown in FIG. 1 ) extending from the underside off the drain plate 10.

Figure 2:
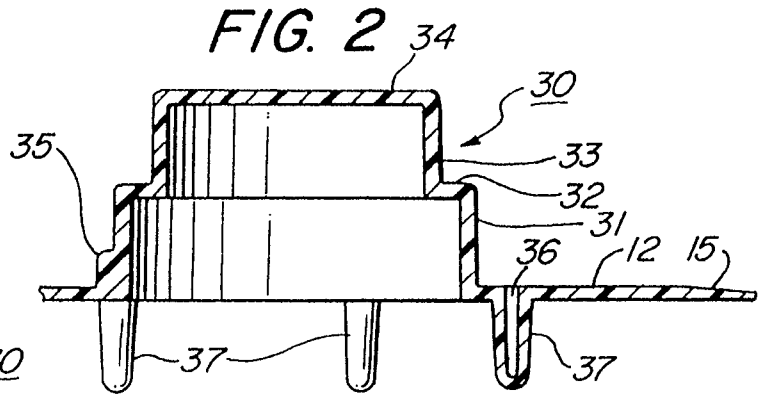
FIG. 2 is a cross-sectional view of the drain plate 10 of FIG. 1 taken along section lines 2—2, illustrating a preferred overflow port 30 thereof.

The overflow port 30 helps drain away standing water that cannot be carried away by the primary port 20, either because the primary port 20 has become clogged with foreign matter of because the rain fall is so heavy that is exceeds its flow capacity. Thus, the purpose of the overflow port 30 is to prevent the roof from collapsing under the weight of standing water. The overflow port 30 is preferably comprised of a pair of "stepped" upstanding walls 31, 33. The contractor installs and adjusts the overflow port 30 to ensure that water will drain only after having reached a certain predetermined level. The acceptable level of standing water (e.g. 2", 2½", etc..) is specified in various building regulations and varies from community to community. As shown in FIGS. 1 and 2, the raised walls 31, 33 of the overflow drain are comprised of a larger lower portion 31 and a smaller upper portion 33. The smaller upper portion 33 is carried by an annular shoulder 32 located at the top of the larger lower portion 31.

The top of tile overflow port 30 is preferably manufactured with an integral flat top section 34 so that, if desired, the drain plate 10 may be installed only as a primary drain. However, when the overflow port 30 will be used, tile contractor may remove the flat top section 34, some or all of the cylindrical extension 33, and even some of the cylindrical base 31.

The "stepped" overflow ports 30, 30' allow great versatility. In particular, as suggested by FIG. 10, the overflow port 30 of the first alternative drain plate 10 may be cut to receive the 3" diameter pipe 73 or the 4" diameter pipe 74. Similarly, the overflow port 30' of the second alternative drain plate 10' may be cut to receive the 2" diameter pipe 72 or the 3" diameter pipe 73.

The first alternative drain plate 10 has a "stepped" overflow port 30 with a 4" lower portion 31 and a 3" upper portion 33. The second alternative drain plate 10' has a stepped overflow drain 30' with a 3" lower portion 31' and a 2" upper portion 33'. The just-described dimensions of the overflow ports 30, 30' refer to inside diameters. For example, as shown in FIG. 8, the first alternative drain plate 10 has an overflow port 30 with the larger lower portion 31 having an inside diameter SD1 of 4" for accommodating the 4" drain pipe 74 and the smaller upper portion 33 having an inside diameter SD2 of 3" for accommodating the 3" drain pipe 73 (as shown). The exterior of the overflow port 30 is preferably round, as shown, but other configurations are possible. Thus, the outer dimension of the overflow port 30 may or may not have a diameter.

Figure 5:
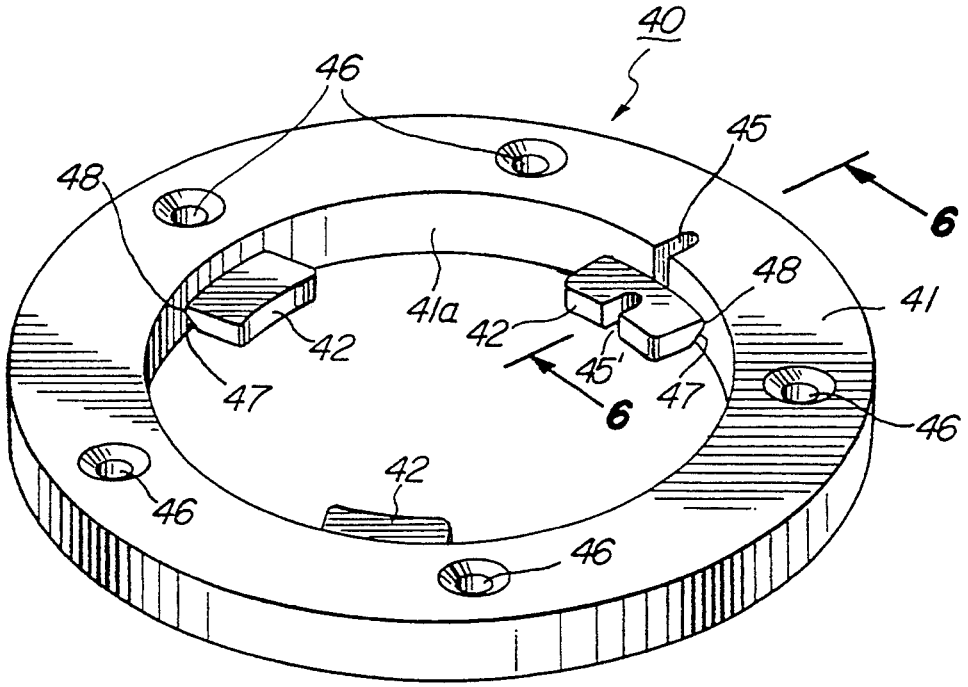
FIG. 5 is a perspective view of a clamp ring 40 of the preferred roof drain structure.

FIG. 5 illustrates the construction of the preferred clamp ring 40. The preferred clamp ring 40 is comprised of an annular body 41, a plurality of screw apertures 46, and three inwardly extending spokes 42 carried by an inner wall 41*a*. As shown in FIG. 8, the clamp ring 40 is used to mechanically pinch the roofing substrate 70 around the base 31 of the roof drain 10. This mechanical clamping action helps prevent the roofing substrate from lifting up at this interface as the roof undergoes great changes in temperature.

The spokes 42 are preferably removable so that, as shown in FIG. 10, the clamp ring 40 may be used with the first and second alternative drain plates 10, 10', even though the have overflow ports 30, 30' with different sized lower portions 31, 31'. The clamp ring 40 fits the first alternative drain plate 10 with the spokes 42 removed, and fits the second alternative drain plate 10' with the spokes 42 left intact.

Figure 6:
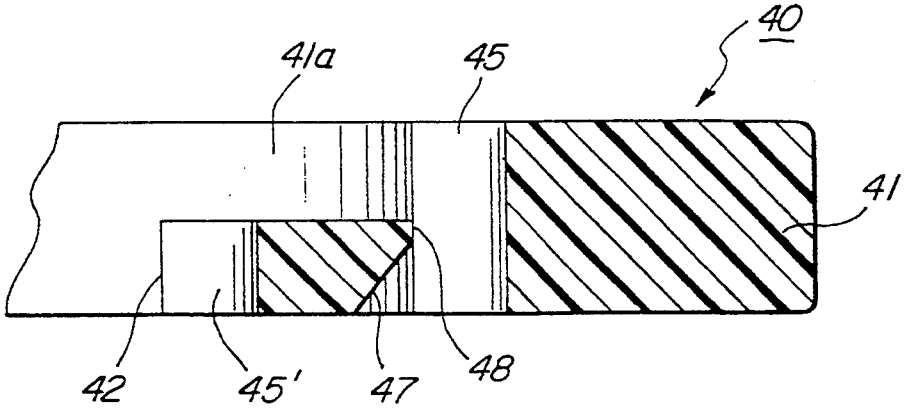
FIG. 6 is a cross-sectional view of the clamp ring 40 of FIG. 5 taken along section lines 6—6, illustrating a preferred removable spoke 42 thereof and a pair of alignment notches 45, 45'.

As shown in FIG. 6, the spokes 42 are removable by virtue of a corresponding undercuts 47 that provide relatively thin, breakable connection joints 48 between the spokes 42 and the inner wall 41*a*. The contractor can easily remove a spoke ,12 by grasping it with plier and bending it back and forth until the connection joint 48 breaks.

The clamp ring 40 1s preferably clamped against the roof drain 10 with a plurality of self-tapping screws 90 (see FIG. 8). The self-tapping screws 90 extend through the plurality of screw holes 46 in the clamp ring 40 into a corresponding plurality of screw apertures 36 and bosses 37 (see FIG. 2) that are provided in tile drain plate 10.

It is of course important to align the screw holes 46 of the clamp ring with the screw apertures 36, 36' of whichever drain plate 10, 10' to which it is attached. A preferred means for orienting the clamp ring 40 in an aligned position is comprised of a unique pair of notches 45, 45' (first engaging portions), shown in FIG. 5, that engage corresponding splines 35, 35' (second engaging portions). A first notch 45 is provided in the annular body 41 of the clamp ring 40. A second notch 45' is provided inwardly adjacent to the first notch 45 in one of the spokes 42. If the spokes 42 are removed from the clamp ring 40, then the first notch 45 is exposed and may engage a spline 35 on the overflow port 30 of the first alternative drain plate 10. If the spokes 42 are left intact, then the second notch 45' on one of the spokes 42 may engage a spline 35' on the overflow port 30' of the second alternative drain plate 10'. Other mechanical interconnections providing alignment are, of course, possible. For example, a portion of the clamp ring could engage a portion of the drain plate 12 instead of a spline 35 on the overflow port 30.

A grate 60 is generally provided to ensure that foreign matter such as leaves and paper do not enter the overflow port 30. The preferred grate 60 has an annular base 61 that fits into the inside of the 4" pipe 74. However, an adapter must be used to connect the grate 60 to one of the smaller pipes 72, 73. A first adapter 50 is used to connect the grate to the 2" pipe 72 and a second adapter 50' is used to connect the grate 60 to the 3" pipe 73. The adapter 50 includes a pair of screw apertures 53. A plurality of self tapping screws 63 are preferably used to attach the grate 60 to the screw apertures of the first adapter 50, the second adapter 50', or to screw apertures drilled into the wall of the 4" pipe (generally thick enough for such modification in the field). The screws 63 are used, rather than cement, so that the grate 60 and the clap ring, as explained below, may be removed for reconstruction of the roof.

Figure 3:
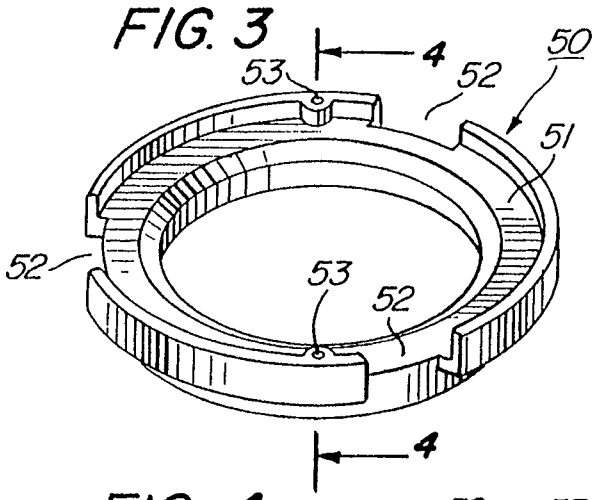
FIG. 3 is a perspective view of a grate adapter 50 of the preferred roof drain structure.
Figure 4:
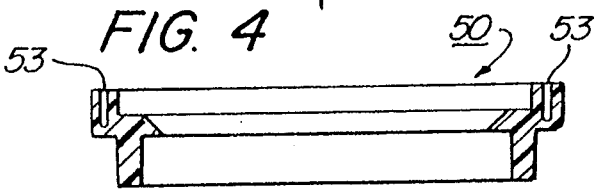
FIG. 4 is a cross-sectional view of the grate adapter 50 of FIG. 3 taken along section lines 4—4.

FIGS. 3 and 4 illustrate a preferred construction for the first adapter 50. The first and second adapters 50, 50' are structurally similar except for the diameter of their lower adapter-to-pipe side. As already noted, the first adapter 50 is provided to interface the grate 60 to the 2" pipe 72 and the second adapter 50' is provided to interface the grate 60 the 3" pipe 73.

The adapters 50, 50' are usually cemented permanently to the respective pipes 72, 73 with a solvent such as PVC cement. Because of the permanent connection between the adapter 50 and the smaller pipes 72, 73, the adapter 50 is provided with a plurality of notches 52 that spatially correspond to the spokes 42 of the clamp ring 40. The resulting benefit is suggested by FIG. 9 wherein the grate 60 has already been unscrewed from the adapter 50. As shown, the clamp ring 40 may then be unscrewed from the drain plate 10 and lifted up and past the permanently cemented adapter 50, its spokes 42 passing through the notches 52.

FIGS. 7*a* through 7*e* illustrate the steps of an exemplary installation of the preferred roof drain structure 100 according to the present invention.

FIG. 7*a* shows the preferred drain plate 10 of FIG. 1 being installed onto a 3" drain pipe 73 located in an aperture 82 of a roof 80. The drain pipe 73 is preferably a short segment so that a rubber expansion coupling (not shown) may connect the segment to a longer drain pipe to accommodate expansion and contraction.

FIG. 7*b* shows a top-most portion 73*a* of the drain pipe 73 being cut off at line "x" in order to ultimately achieve a desired flood level A' (see FIG. 8), and a plurality of screws 17 used to attach the drain plate 10 to the roof 80 through apertures 16.

FIG. 7*c* shows a substrate 70, comprised of felt and tar, being applied onto the roof 80 and over the drain plate 10 with a mop 71. The clamp ring 40 is then installed around the lower portion 31 of the overflow port 30. As suggested, the notch 45 of the clamp ring 40 engages the spline 35 located on the lower portion 31 of the overflow port 30 in order to align the screw apertures 36, 46. A plurality of screws 90 are then used to secure the clamp ring 40 firmly against the drain plate 10.

FIG. *7d* illustrates the installation of the 3" grate adapter 50 and the grate 60. The adapter 50 is permanently cemented to the pipe 73 and the grate 60 is removably screwed onto the adapter 50.

FIG. *7e* and 8 are respectively a perspective and a cross-sectional view of the completed roof drain structure 100.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. A drain structure for removing water from a substantially flat roof comprising:

a drain plate having a substantially flat body sized to cover an aperture cut in the substantially flat roof;

an overflow port comprised of a hollow boss extending upwardly from the flat body of said drain plate;

a plurality of first screw apertures formed in the flat body of said drain plate around said overflow port;

a clamp ring sized to fit around the hollow boss of said overflow port so that an edge portion of a roof membrane which surrounds the hollow boss may be securely clamped to the flat body of said drain plate to help prevent water from leaking under the edge portion of the roof membrane;

a plurality of second screw apertures formed about a periphery of said clamp ring, said second screw apertures spatially corresponding to said first screw apertures when said clamp ring is oriented in a particular position relative to the flat body of said drain plate; and means for orienting said clamp ring in the particular position where said second screw apertures of said clamp ring align with said first screw apertures of said base plate.

2. The drain structure of claim 1 wherein said orienting means comprises:

a first engaging portion of said clamp ring; and a second engaging portion of one of said drain plate and said overflow port, the second engaging portion cooperatively engaging with the first engaging portion when said clamp ring is oriented in the particular position wherein the first and second screw apertures are aligned.

3. The drain structure of claim 2 wherein the hollow boss of said overflow port is comprised of:

a lower portion having a first height and a first internal diameter for receiving a first size pipe; and an upper portion having a second height and a second smaller internal diameter for receiving a second size pipe, the upper and lower portions being horizontally severable at a desired point along their respective heights to provide said overflow port with a through hole having one of the first and second internal diameters whereby a desired one of the first and second size pipes may extend through said overflow port.

4. The drain structure of claim 3 wherein said drain plate and said overflow port are integrally formed of plastic.

5. The drain structure of claim 4 wherein the plastic is a thermoplastic selected from the group including ABS plastic, PVC, polyethylene, polypropylene, and styrene.

6. The drain structure of claim 3 wherein said overflow port is made of metal.

7. The drain structure of claim 6 wherein the metal is one of cast iron and copper.

8. The drain structure of claim 3 wherein the hollow boss of said overflow port is further comprised of:

a solid top surface integrally formed at a topmost end of the upper portion which initially seals said overflow port, said solid top surface being left intact to install the drain structure without using said overflow port and said solid top surface being severed, along with a desired amount of the upper and lower portions, to install the drain structure using said overflow port with one of the first and second size pipes.

9. The drain structure of claim 3 wherein the upper and lower portions of the hollow boss of said overflow port are respectively comprised of upper and lower cylindrical members.

10. The drain structure of claim 9 wherein said clamp ring is substantially annular in shape and sized to fit around an exterior wall of the lower cylindrical member of said overflow port.

11. The drain structure of claim 10 wherein the first and second portions of said orienting means respectively comprise:

a vertical slot formed in said clamp ring; and a vertical spline formed on the exterior wall of the lower cylindrical member of said overflow port, the vertical spline of said overflow port cooperatively engaging with the vertical slot of said clamp ring when said clamp ring is oriented in the particular position wherein the first and second screw apertures are aligned.

12. The drain structure of claim 11 wherein said clamp ring comprises:

an annular body having an inner wall of a first diameter;

a first vertical slot formed in the inner wall of the annular body, the first vertical slot engaging a vertical spline of a first drain plate having a lower cylindrical portion of a first larger diameter;

a plurality of removable spokes having inner ends, the spokes extending radially inward from the annular body with the inner ends of the spokes located around a second smaller diameter; and a second vertical slot formed in the inner end of at least one spoke, the second vertical slot engaging a vertical spline of a second drain plate having a lower cylindrical portion of a second smaller diameter, whereby said clamp ring may be used alternatively with first and second drain plates having different sized overflow ports, the spokes being left intact if said clamp ring is used with the first drain plate and the spokes being removed if said clamp ring is used with the second drain plate.

13. The drain structure of claim 12 wherein the plurality of spokes of said clamp ring are removable by virtue of a breakable connection between the annular body of said clamp ring and each of the plurality of spokes.

14. The drain structure of claim 13 wherein the first vertical slot formed in the annular body of said clamp ring is located behind the breakable connection, the first vertical slot being exposed only after removal of the at least one spoke.

15. The drain structure of claim 12 further comprising:

a grate having a bottom end sized to mate with the first size pipe; and an adapter ring having a top end sized to mate with the bottom end of said grate and a bottom end sized to mate with the second size pipe.

16. The drain structure of claim 12 further comprising:

a grate having a bottom end that is larger than the second smaller diameter defined by the inner ends of the spokes of said clamp ring;

an adapter ring for adapting said grate to one of the first and second size pipes, said adapter ring having an exterior wall with a top end sized to mate with the bottom end of said grate and a bottom end sized to mate with one of the first and second size pipes; and a plurality of notches defined around the exterior wall of said adapter ring, said notches spatially aligned with and sized to receive the spokes of said clamp ring so that, even though the diameter of the exterior wall of said adapter ring is larger than the second smaller diameter defined by the inner ends of the spokes of the clamp ring, said clamp ring and its spokes may be passed by said adapter ring without removing said adapter ring from the pipe with which it is mated.

17. The drain structure of claim 3 further comprising:

a grate having a bottom end sized to mate with the first size pipe; and an adapter ring having a top end sized to mate with the bottom end of said grate and a bottom end sized to mate with the second size pipe.

18. The drain structure of claim 3 further comprising:

a grate having a bottom end sized to mate with a third size pipe that is larger than the first and second size pipes; and an adapter ring for adapting the grate to one of the first and second size pipes, said adapter ring having a top end sized to mate with the bottom end of the grate and a bottom end sized to mate with one of the first and second size pipes.

19. A drain system for use with a substantially flat roof comprising:

first and second alternative drain plates, each alternative drain plate having a substantially flat body sized to cover an aperture cut in the roof and an overflow port comprised of a hollow boss extending upwardly from the flat body of each drain plate, said hollow boss being horizontally severable along a height thereof, the hollow boss of said first alternative drain plate having a lower cylindrical portion sized for a first size pipe and the hollow boss of said second alternative drain plate having a lower cylindrical portion sized for a second smaller size pipe; and a clamp ring that may be modified in the field for use with either of said first and second alternative drain plates, said clamp ring having an annular body with an inner wall of a first diameter sized to fit around the lower cylindrical portion of said first alternative drain plate, and said clamp ring further having a plurality of removable spokes extending radially inward from the inner wall of said clamp ring and having inner ends that define a second diameter sized to fit around the lower cylindrical portion of said second alternative drain plate.

20. The drain system of claim 19 wherein said first and second alternative drain plates each include a first plurality of screw apertures formed in the flat body of said drain plate around the overflow port and wherein said clamp ring includes a second plurality of screw apertures formed about a periphery of said clamp ring, said second screw apertures aligning with said first screw apertures when said clamp ring is oriented in a particular position relative to the flat body of said first and second alternative drain plates.

21. The drain system of claim 20 further comprising means for orienting said clamp ring in the particular position where the second screw apertures of said clamp ring align with the first screw apertures of said first and second alternative drain plates.

22. The drain system of claim 21 wherein said orienting means is comprised of a means for engaging a portion of said clamp ring with a portion of one of the overflow port and the flat body of said first and second alternative drain plates.

23. The drain system of claim 19 further comprising:

a grate having an annular base portion nominally sized for connection to a top end of the first size pipe; and an annular adapter for connecting the base portion of the grate to a top end of the second smaller size pipe, whereby the grate may be connected to either size pipe in the field.

24. The drain system of claim 23 wherein the annular adapter includes a plurality of notches defined around an exterior wall of said annular adapter, said notches being spatially aligned with and sized to allow passage of tile removable spokes of said clamp ring so that, even though the removable spokes may extend inwardly beyond tile exterior wall of said adapter ring, there is no need to remove the adapter ring to remove the clamp ring.

25. An improved overflow drain for a substantially flat roof comprising:

a drain plate having a substantially flat body sized to cover an aperture cut in the substantially flat roof;

an overflow port comprised of a hollow boss extending upwardly from the flat body of the drain plate, the hollow boss comprised of a lower portion of a first height and having a first internal diameter for receiving a first pipe of a first diameter and an upper portion of a second height having a second internal diameter for receiving a second pipe of a second diameter, the upper and lower portions being severable along a desired portion of their respective heights to form a hole corresponding to one of the first and second internal diameters whereby a desired one of the first and second pipes may extend through the overflow port;

a clamp ring sized to fit around the lower portion of the hollow boss so that an edge portion of a roof membrane which surrounds the overflow port may be securely clamped to the drain plate;

a plurality of first screw apertures formed about a periphery of said clamp ring;

a plurality of second screw apertures formed in the flat drain plate and spatially corresponding the first screw apertures; and means for aligning the first screw apertures of the clamp ring with the second screw apertures of the drain plate.

* * * * *